US010961876B2

(12) United States Patent
Andrisani et al.

(10) Patent No.: US 10,961,876 B2
(45) Date of Patent: Mar. 30, 2021

(54) ROCKER ARM

(71) Applicant: EATON INTELLIGENT POWER LIMITED, Dublin (IE)

(72) Inventors: Nicola Andrisani, Cumiana (IT); Emanuele Raimondi, San Francesco Al Campo (IT); Alessio Lorenzon, Avigliana (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 211 days.

(21) Appl. No.: 16/300,593

(22) PCT Filed: Apr. 21, 2017

(86) PCT No.: PCT/EP2017/059523
§ 371 (c)(1),
(2) Date: Nov. 12, 2018

(87) PCT Pub. No.: WO2017/194291
PCT Pub. Date: Nov. 16, 2017

(65) Prior Publication Data

US 2020/0308993 A1 Oct. 1, 2020

(30) Foreign Application Priority Data

May 12, 2016 (GB) ..... 1608385
Mar. 9, 2017 (GB) ..... 1703792

(51) Int. Cl.
*F01L 1/18* (2006.01)
*F01L 1/46* (2006.01)

(52) U.S. Cl.
CPC *F01L 1/18* (2013.01); *F01L 1/46* (2013.01); *F01L 2001/187* (2013.01)

(58) Field of Classification Search
CPC ..... F01L 1/18; F01L 1/46; F01L 2001/187
See application file for complete search history.

(56) References Cited

U.S. PATENT DOCUMENTS

2016/0169064 A1* 6/2016 Radulescu ..... F01L 1/18 123/90.16

FOREIGN PATENT DOCUMENTS

DE 102009033634 A1 1/2011
WO WO 2015181264 A1 12/2015

* cited by examiner

*Primary Examiner* — Zelalem Eshete
(74) *Attorney, Agent, or Firm* — Leydig, Voit & Mayer, LTD.

(57) ABSTRACT

A rocker arm for a valve train assembly includes: a first body; a second body mounted for pivotal movement with respect to the first body; and a latching arrangement. The latching arrangement includes a latch pin drivable in response to an external actuator from a first position in which the first body and the second body are un-latched to a second position in which the latch pin latches the first body and the second body together. The latching arrangement includes a piston member and a first biasing member. The piston member is arranged such that if the external actuator attempts to cause the latch pin to be driven from the first position to the second position at a time when the latch pin is prevented from being driven, the piston member moves to bias the biasing member so that the biasing member urges the latch pin to the second position.

15 Claims, 7 Drawing Sheets

ROCKER ARM

CROSS-REFERENCE TO PRIOR APPLICATIONS

This application is a U.S. National Phase application under 35 U.S.C. § 371 of International Application No. PCT/EP2017/059523, filed on Apr. 21, 2017, and claims benefit to British Patent Application No. GB 1608385.9, filed on May 12, 2016, and British Patent Application No. GB 1703792.0, filed on Mar. 9, 2017. The International Application was published in English on Nov. 16, 2017 as WO 2017/194291 under PCT Article 21(2).

FIELD

The present invention relates to a rocker arm for a valve train assembly of an internal combustion engine.

BACKGROUND

Rocker arms for control of valve actuation by switching between at least two or more modes of operation are well known. Such rocker arms typically involve multiple bodies, such as an inner arm and an outer arm that are latched together by a latch pin to provide one mode of operation and are unlatched, and hence can pivot with respect to each other, to provide a second mode of operation. The first mode of operation may, for example, be a normal engine cylinder combustion mode in which the latched rocker arms pivot together as a single body in response to a rotating cam profile in order to operate a cylinder valve and the second mode of operation may, for example, be a cylinder de-activation mode in which one of the un-latched rocker arms pivots with respect to the other rocker arm in response to the rotating cam profile and absorbs the action of the cam profile as 'lost motion' without exerting a force on the cylinder valve which remains closed.

In some valve train assemblies that comprise such rocker arms the latch pins of the rocker arm are caused to be moved from an un-latched position to a latched position by an actuator that is external to the rocker arms.

It is known that in some circumstances, when it is required for the latch pin to be moved into the latched position, the timing at which the external actuator is activated must be controlled very precisely otherwise the actuator may attempt to cause the latch pin to move at a time when the latch pin is unable to move, for example, because of the current orientation of the two bodies of the rocker arm.

It is therefore desirable to provide improved a rocker arm.

SUMMARY

In an embodiment, the present invention provides a rocker arm for a valve train assembly, the rocker arm comprising: a first body; a second body mounted for pivotal movement with respect to the first body; and a latching arrangement comprising a latch pin drivable in response to an external actuator from a first position in which the first body and the second body are un-latched to a second position in which the latch pin latches the first body and the second body together, wherein the latching arrangement further comprises a piston member and a first biasing member, and wherein the piston member is configured such that if the external actuator attempts to cause the latch pin to be driven from the first position to the second position at a time when the latch pin is prevented from being driven, the piston member moves to bias the biasing member so that the biasing member urges the latch pin to the second position when the latch pin again becomes driveable.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Advantageously, because the first biasing member the and piston member help ensure that the latch pin 42 is moved into the latching position, there is no need to carefully control the timing of the external actuator to be synchronous with the inner body ending a return stroke.

One of the first and second body may comprise a bore or channel and the latch pin and the first biasing member may be at least partially mounted within the bore or channel. That the first biasing member is at least partially within the bore or channel provides for a compact arrangement.

The piston member may also at least partially be within the bore or channel which provides for a compact arrangement.

According to a second aspect of the present invention, there is also provided a valve train assembly comprising the rocker arm of the first aspect.

Figure 1:
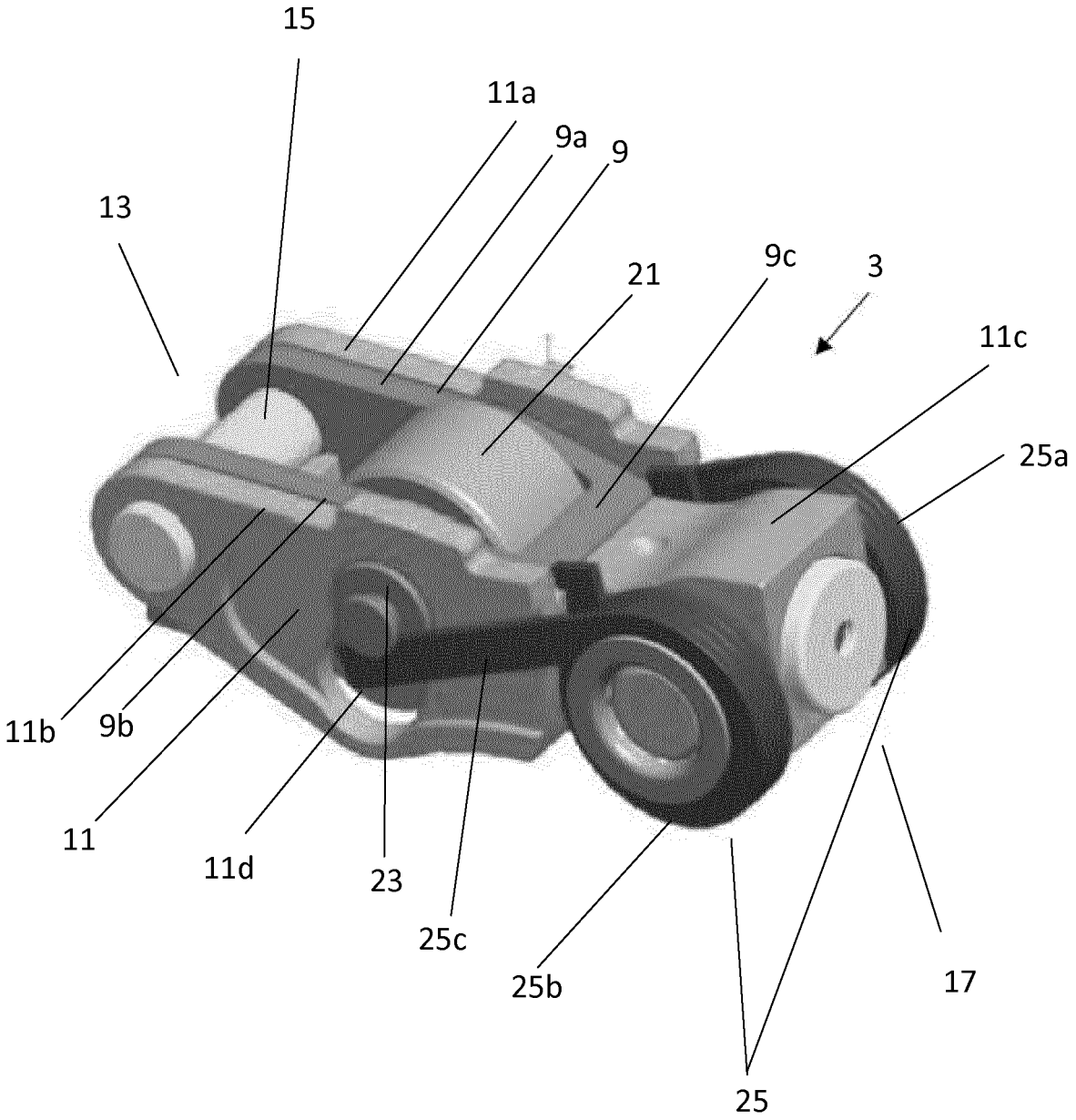
FIG. 1 shows a schematic perspective view of a first rocker arm.
Figure 2:
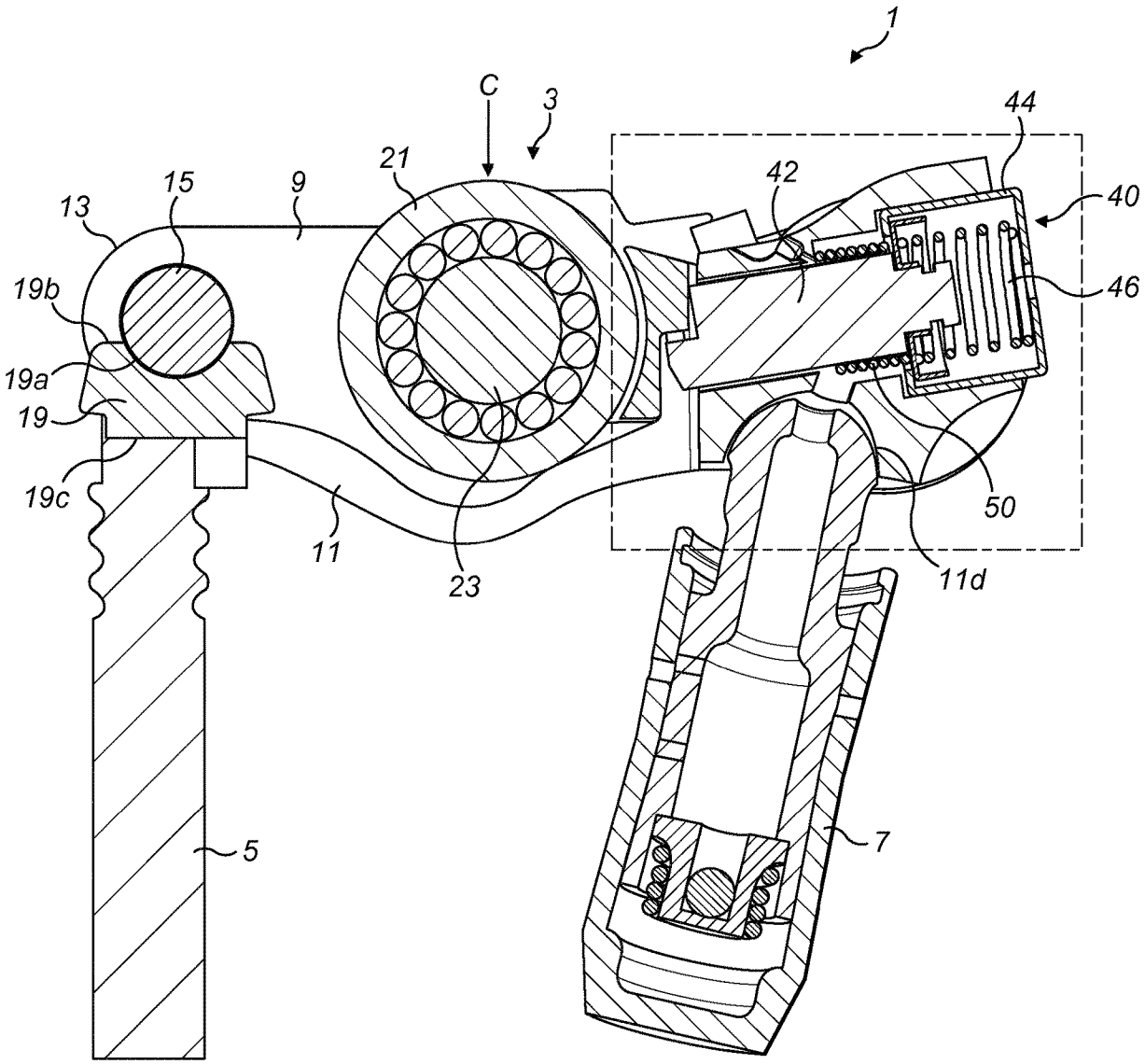
FIG. 2 shows a schematic cross sectional view of a valve train assembly including the first rocker arm.

Referring first to FIGS. 1 and 2, there is illustrated schematically, a valve train assembly 1 that comprises a rocker arm 3, an engine valve 5 for an internal combustion engine cylinder and a lash adjustor 7. The rocker arm 3 comprises an inner body or arm 9 and an outer body or arm 11. The inner body 9 and the outer body 11 are pivotally mounted at a first end 13 of the rocker 3 on a shaft 15 which serves to link the inner body 9 and outer body 11 together.

The outer body 11 comprises two generally parallel side walls 11*a* and 11*b* which define a space which contains the inner body 9 and an outer body end section 11*c* which defines a second end 17 of the rocker 3 and which connects the side walls 11*a* and 11*b* together.

The inner body 9 comprises two generally parallel side walls 9*a* and 9*b* which are adjacent to and run alongside the side walls 11*a* and 11*b* respectively of the outer body 11 and an inner body end section 9*c* which connects the side walls 9*a* and 9*b* together and opposes the outer body end section 11*c*.

Each of the outer body 11 side walls 11*a* and 11*b* and the inner body side walls 9*a* and 9*b* comprises an aperture (not labelled) which apertures are aligned and in which the shaft 15 is received.

The rocker arm 3 further comprises a contact pad (or so called 'Elephant's foot') 19 that extends between the parallel side walls 9*a* and 9*b* of the inner body 9 at the first end 13 of the rocker 3. The contact pad 19 comprises a first surface 19*a* that defines a recess 19*b* that receives the shaft 15 and a second surface 19*c* that contacts the shaft of the engine valve 5.

At the second end 17 of the rocker 3 the outer body end section 11*c* is provided with a recess 11*d* for receiving an end of the lash adjustor 7 so that the rocker arm 3 is mounted for pivotal movement about the lash adjustor 7. The lash adjuster 7 which is supported in an engine block may, for example, be a hydraulic lash adjuster, and is used to accommodate slack (or lash) between components in the valve train assembly 1. Lash adjusters are well known per se and so the lash adjuster 7 will not be described in any detail.

The rocker arm 3 is provided with a cam follower 21 which in this example is a roller follower and is located in a space defined between the side walls 9*a* and 9*b* of the inner body 9. The roller follower 21 is rotatably mounted (by bearings for example) on an axle or shaft 23 which extends through aligned apertures (only the aperture 11*d* in the wall 11*b* is visible in the Figures) in the walls 9*a*, 9*b*, 11*a*, 11 *b*.

The rocker arm 3 is further provided with a lost motion return spring arrangement 25 comprising a pair of springs 25*a*, 25*b*, for example torsional springs. Each of the springs 25*a*, 25*b* is mounted on a respective side of the outer body end section 11*c* and each comprises a respective spring arm 25*c* that extends along the outside of a side wall 11*a*, 11*b* and at one end supports the shaft 23.

The valve train assembly 1 further comprises a rotatable camshaft comprising a cam (illustrated schematically by arrow C). The cam C is for engaging the roller follower 21. The cam 32 comprises a lift profile and a base circle.

The rocker arm 3 further comprises a latching arrangement 40 comprising an elongate latch pin 42 that is drivable in response to an external actuator (not represented in FIGS. 1 and 2) from a first position in which the inner body 9 and the outer body 11 are un-latched to a second position in which the latch pin 42 latches the inner body 9 and the outer body 11 together so that they act as a single body. The latching arrangement 40 will be described in further detail below.

When the latch pin 42 is in the first position (i.e. the inner body 9 and the outer body 11 are un-latched) the rocker arm 3 is in a first mode and when the latch pin 42 is in the second position (i.e. the inner body 9 and the outer body 11 are latched together as is illustrated in FIG. 2) the rocker arm 3 is in a second mode. In this example, the first mode is a cylinder de-activation mode in which there is no valve lift event in a given engine cylinder cycle (e.g. in a given full rotation of the cam shaft 30) and the second mode is a normal cylinder combustion mode in which there is a valve lift event in any given engine cylinder cycle (e.g. in a given full rotation of the cam shaft 30).

During engine operation when the rocker 3 is in the first mode (i.e. cylinder de-activation mode) as the cam shaft rotates, the cam (C)'s lift profile engages the roller follower 21 exerting a force that causes the inner body 9 to pivot relative to the outer body 11 about the shaft 15 from a first orientation that the inner body 9 adopts when the base circle engages the roller follower 21 to a second orientation that the inner body adopts 9 when the peak of the lift profile engages the roller follower 21. This movement of the inner body 9 'absorbs' as 'lost motion' the motion that would otherwise be transmitted from the cam (C) to the valve 5 and hence the valve 5 remains closed. As the peak of the of the lift profile passes out of engagement with the roller follower 21 and subsequently the base circle engages the roller follower 21 again, the inner body 9 is urged by the lost motion return spring arrangement 25 from the second orientation back to the first orientation.

During engine operation when the rocker arm 3 is in the second mode (i.e. normal cylinder combustion mode) as the cam shaft rotates, the cam (C)'s lift profile engages the roller follower 21 exerting a force that causes the rocker arm 3 to pivot about the lash adjuster 7 to lift the valve 5 (i.e. move it downwards in the sense of the page) against the force of a valve return spring thus opening the valve 5. As the peak of the lift profile passes out of engagement with the roller follower 21 the valve return spring begins to close the valve 5 (i.e. the valve 5 is moved upwards in the sense of the page) and the rocker arm 3 pivots about the lash adjuster 7 in the opposite sense to when the valve 5 is opening. When the base circle again engages the first roller follower 21 the valve 5 is fully closed and the valve lift event is complete.

Figure 3:
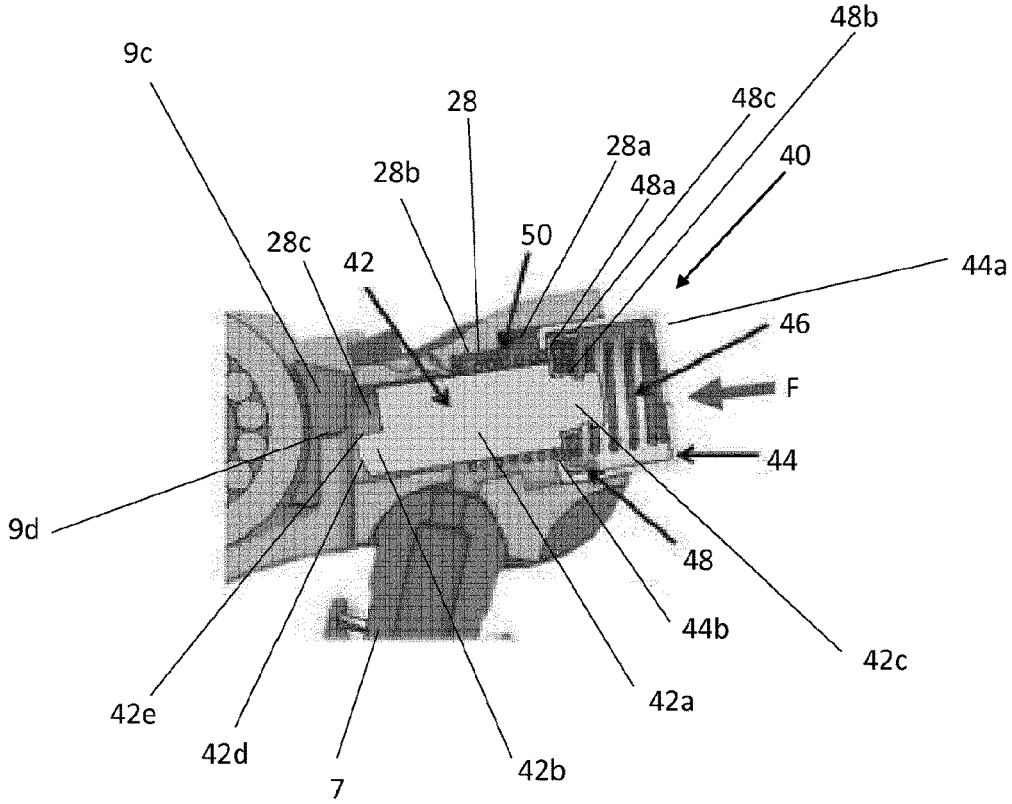
FIG. 3 shows a schematic cross sectional view through part of the valve train assembly including part of the rocker arm.

As best illustrated in FIGS. 2 and 3 in this example, in addition to the latch pin 42, the latching arrangement 40 comprises a piston member 44, a first biasing member 46, an annular retention member 48 and a latch pin return spring 50.

The latching arrangement 40 is located in a bore or channel 28 formed in one or other of the inner body 9 and the outer body 11. In this example, the bore 28 is formed in the outer body end section 11*c*.

In this example, the bore 28 is a stepped bore and comprises a first section 28*a*, a second section 28*b* and a third section 28*c*. The first section 28*a* has an open end at the second end 17 of the rocker 3 and the third section 28*c* has an open end that faces the inner body end section 9*c*. The second section 28*b* is between and connects the first section 28*a* and the third section 28*c*. The width (e.g. diameter) of the first section 28*a* is greater than the width of the second section 28*b* which is greater than width of the third section 28*c*.

The latch pin 42 comprises a main body portion 42*a*, a first end portion 42*b* and a second end portion 42*c*. The first end portion 42*b* faces the end section 9*c* of the inner body 9 and comprises a lip section 42*d* that extends from the main body portion 42*a* and defines a latch pin contact surface 42*e*. The second end portion 42*c* is a shoulder portion of smaller diameter than the main body portion 42*a* and extends from the main body portion 42*a*.

The piston member 44 is slideably received in the first bore section 28*a*. The piston member 44 is a hollow member, for example a hollow cylinder, and comprises a capped end 44*a* that is substantially closed and an open end 44*b*. The closed end 44*a* protrudes from the open end of the first bore section 28*a* and the open end 44*b* of the piston member 44 faces towards the second section 28*b* of the bore 28. That the piston member 44 is at least partially within the bore 28 provides for a compacter arrangement than would be the case if it were entirely external of the bore 28.

The latch pin 42 is arranged in the bore 28 with its second end portion 42*c* extending through the open end 44*b* of the piston member 44 part of the way into the hollow interior of the piston member 44.

The first biasing member 46, which in this example is a spring, is arranged in the hollow interior of the piston member 44 with a first end around the second end portion 42*c* of the latch pin 42 and a second end against the closed end 44*a* of the piston member 44.

The latching arrangement 40 further comprises the annular retention member 48 that is arranged inside the hollow interior of the piston member 44 adjacent to an annular lip of the piston 48 which lip extends around the open end 44*b* of the piston member 44. The annular retention member 48 comprises a base portion 48*a*, an inner wall 48*b* and an outer wall 48*c*.

The second end portion 42*c* of the latch pin 42 passes through the aperture of the annular retention member 48. The base 48*a* of the annular retention member 48 contacts the main body portion 42*a* of the latch pin 42, the inner wall 48*b* of the annular retention member 48 contacts the second end portion 42*c* of the latch pin 42 and the outer wall 48*c* of the annular retention member 48 is adjacent to but spaced apart from the inner wall of the piston 44. The base portion 48*a*, the inner wall 48*b* and the outer wall 4*bc* of the retention member 48 define an annular channel in which is supported the first end of the biasing means 46.

The latch pin return spring 50 is arranged around a part of the main body portion 42*a* of the latch pin 42 and has one end fixed in the second section 28*b* of the bore 28 and another end contacting or fixed to the base 48*a* of the annular retention member 48.

FIG. 3 illustrates a 'steady state' condition in which the base circle of the cam (C) is engaging the roller follower 21 and the rocker arm 3 is in the first mode (i.e. cylinder de-activation mode) and the latch pin 42 is fully retracted. In this condition, the first biasing member 46 maintains the piston member 44 extended as far as it can out of the open end of the first section of the bore 28. It will be appreciated that the annular retention member 48 functions to prevent any further extension of the piston member 44 out of the open end of the first section of the bore 28 (i.e. the annular retention member 48 limits the extension stroke of the piston member 44).

In this condition, when it is required to configure the rocker arm 3 into the second mode (i.e. normal engine condition mode), for example, as determined by an engine control system, an external actuator (represented by arrow F) applies a force to the piston member 44, for example by pushing on the closed end 44*a*.

The biasing or spring force (e.g. stiffness) of the first biasing member 46 is much higher than that of the return spring 50 and so accordingly the force of the actuator (F), be it through pushing or otherwise, is transmitted to the latch pin 42 through the first biasing member 46 as the piston member 44 moves in the first section of the bore 28 and the latch pin 42, which is free to move, is caused to move against the bias of the return spring 50 into a fully extended position in which it latches the inner body 9 and outer body 11 together. In this position, the flat contact surface 42*e* of the latch pin 42 engages a corresponding contact surface 9*d* of the end 9*c* of the inner body 9.

In this second mode, the rocker arm 3 will function as previously described above in response to the rotating cam. When it is required to return the rocker arm 3 to the first mode, the external actuator (F) is controlled to stop exerting a force on the piston 44 and the return spring 50 causes the latch pin 42 and the piston member 44 to return to the fully retracted position.

Figure 4:
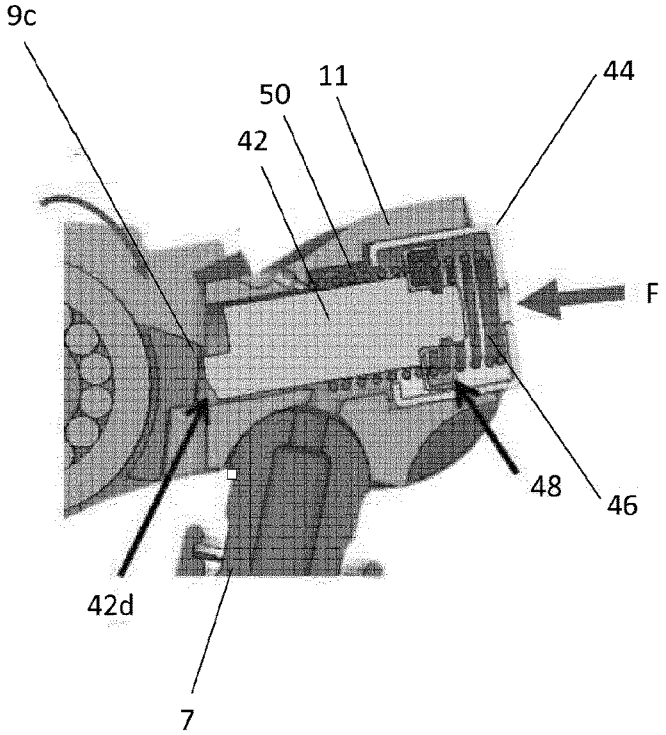
FIG. 4 shows another schematic cross sectional view through part of the valve train assembly including part of the rocker arm.

Referring now to FIG. 4, if the external actuator (represented by arrow F) applies a force to the piston member 44 to try to cause the latch pin 42 to move from the fully retracted position (i.e. unlatched position) to the fully extended position (i.e. latched position) at a time when the latch pin 42 is unable to move, the external actuator causes the piston member 44 to move further into the first section of the bore 28 and off the annular retention member 48 to compress the first biasing member 46.

The latch pin 42 may be prevented from moving, for example, because as is illustrated in FIG. 4. the inner arm 9 is moving and has not yet returned to the position it adopts when the cam base circle is engaged with the roller follower 21 so that the inner arm 9 physically abuts the latch pin 42 to prevent it from moving.

Figure 5:
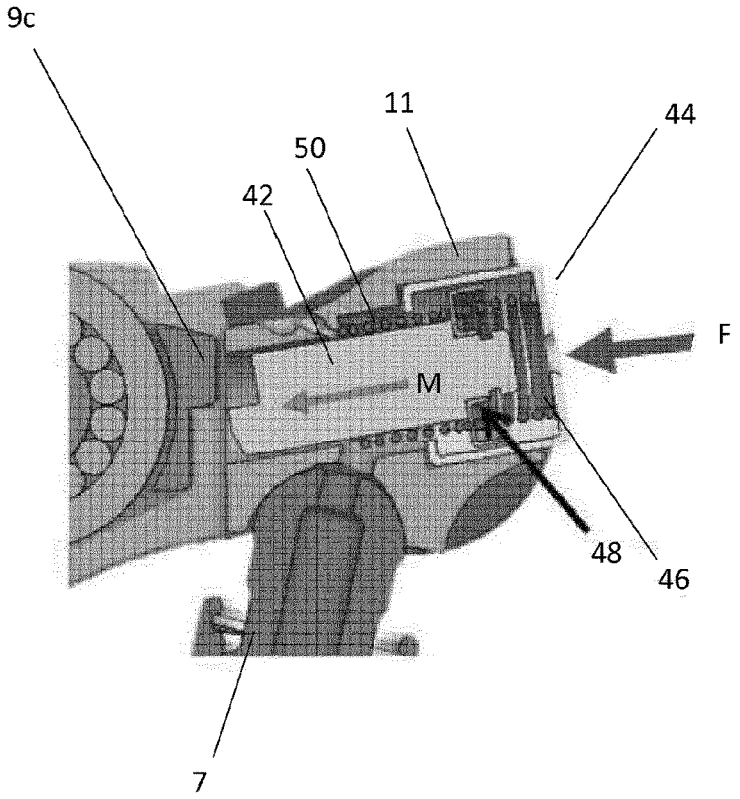
FIG. 5 shows another schematic cross sectional view through part of the valve train assembly including part of the rocker arm.
Figure 6:
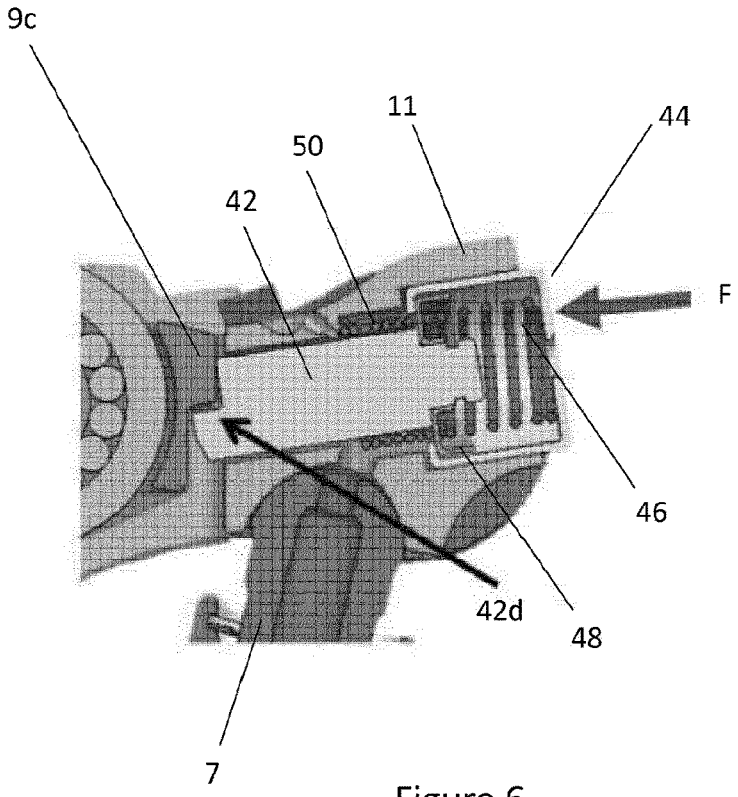
FIG. 6 shows another schematic cross sectional view through part of the valve train assembly including part of the rocker arm.

As is illustrated in FIG. 5, when the inner arm 9 has completed its return stroke (i.e. it is back in the position it adopts when the cam base circle engages the roller follower 21) so that the latch pin 42 is free to move again, the force generated by the compressed first biasing member 46 as it de-compresses within the piston member 44 is stronger than the force required to overcome the return spring 50 and so causes the latch pin 42 to move (as indicated by the arrow M) into the fully extended position, as illustrated in FIG. 6, in which it latches the inner arm 9 and outer arm 11 together.

Advantageously, because the first biasing member 46 and piston member 44 arrangement will ensure that the latch pin 42 is moved into the latching position, there is no need to carefully control the timing of the external actuator to be synchronous with the inner arm 9 ending its return stroke.

Figure 7:
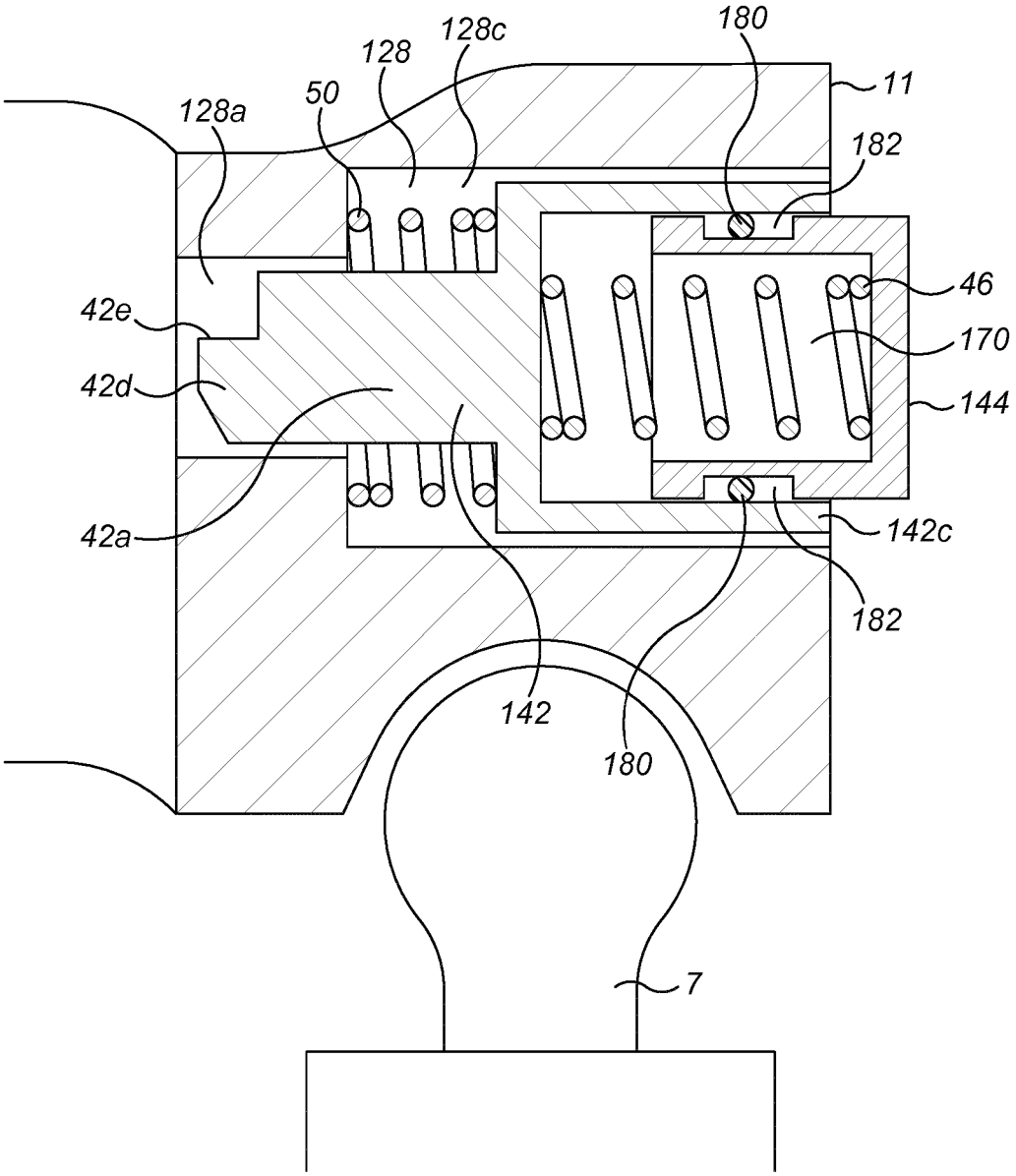
FIG. 7 shows a schematic cross sectional view of a latching arrangement in a rocker arm.

Referring now to FIG. 7, there is illustrated an alternative latching arrangement 140 that may be used in the rocker arm 3 instead of the latching arrangement 40 but which functions in a very similar way. Components of the latching arrangement 140 that are identical to components of the latching arrangement 40 are given identical reference numerals as those used above and for reasons of brevity these components will be not be described in detail again. Components of the latching arrangement 140 that are very similar to components of the latching arrangement 40 are given reference numerals that are increased by one hundred compared to those used above.

In this example it should be noted that a slight difference between the bore 128 formed in the outer body 11 and the similar bore 28 described above is that the bore 128 is a two-step bore (not a three step bore) comprising a bore section 128*a* and a wider bore section 128*c*.

In this example, the second end portion 142*c* of the latch pin 142 is wider than the main body portion 42*a* of the latch pin 142 and the second end portion 142*c* defines a latch pin bore 170 within which the piston 144 is slidably mounted. The first biasing member 46 is between the piston 144 and the latch pin 142 within the latch pin bore 170.

As with the example described above, if the external actuator applies a force to the piston member 144 to try to cause the latch pin 142 to move from the fully retracted position (i.e. unlatched position) to the fully extended position (i.e. latched position) at a time when the latch pin 142 is unable to move (e.g. because of the position of the inner arm as described above), the external actuator causes the piston member 144 to move further into the latch pin bore 170 to compress the first biasing member 46.

Again, when latch pin 142 is free to move, the force generated by the compressed first biasing member 46 as it de-compresses within the latch bore 170 is stronger than the force required to overcome the return spring 50 and so causes the latch pin 142 to move into the fully extended position in which it latches the inner arm (not shown in FIG. 7) and the outer arm 11 together.

A stopper 180 which is in the form of a ring is fixed on the inner surface of the second end portion 142*c* so that the stopper 180 is located in an annular slot 182 defined in the outer surface of the piston 144 serves to limit the extent of the stroke of the piston 144 in both directions.

As with the previously described arrangement, this arrangement is also particularly compact and space efficient.

Figure 8:
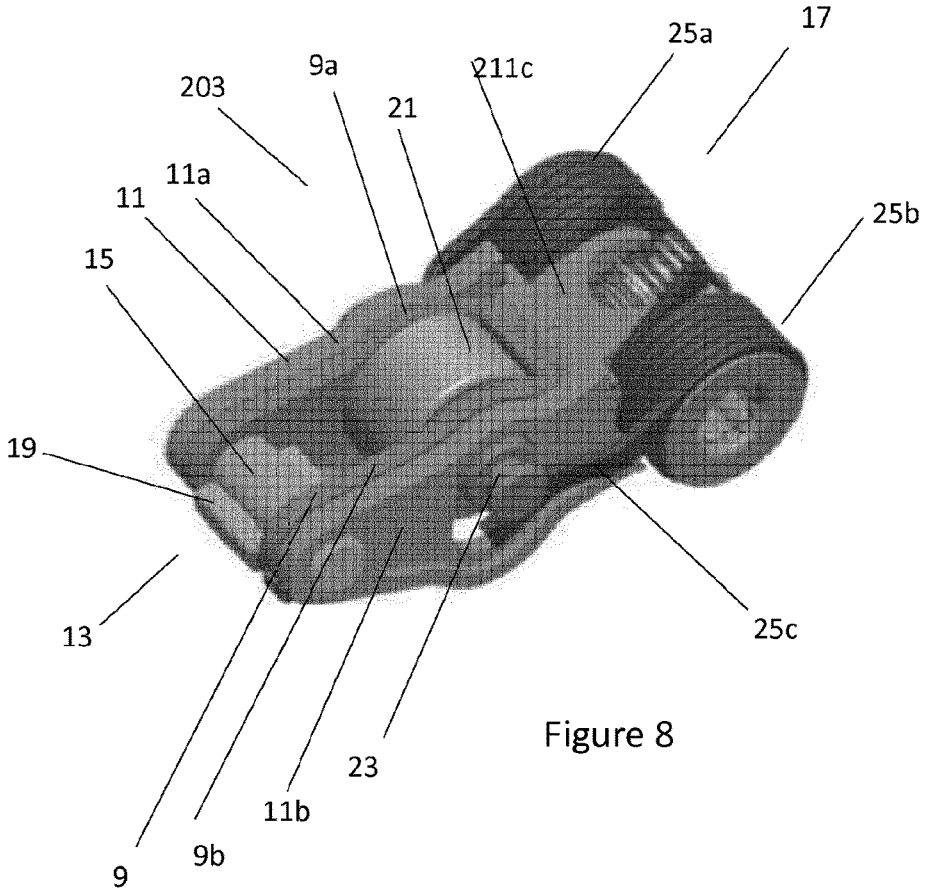
FIG. 8 shows a schematic perspective view of another rocker arm.
Figure 9:
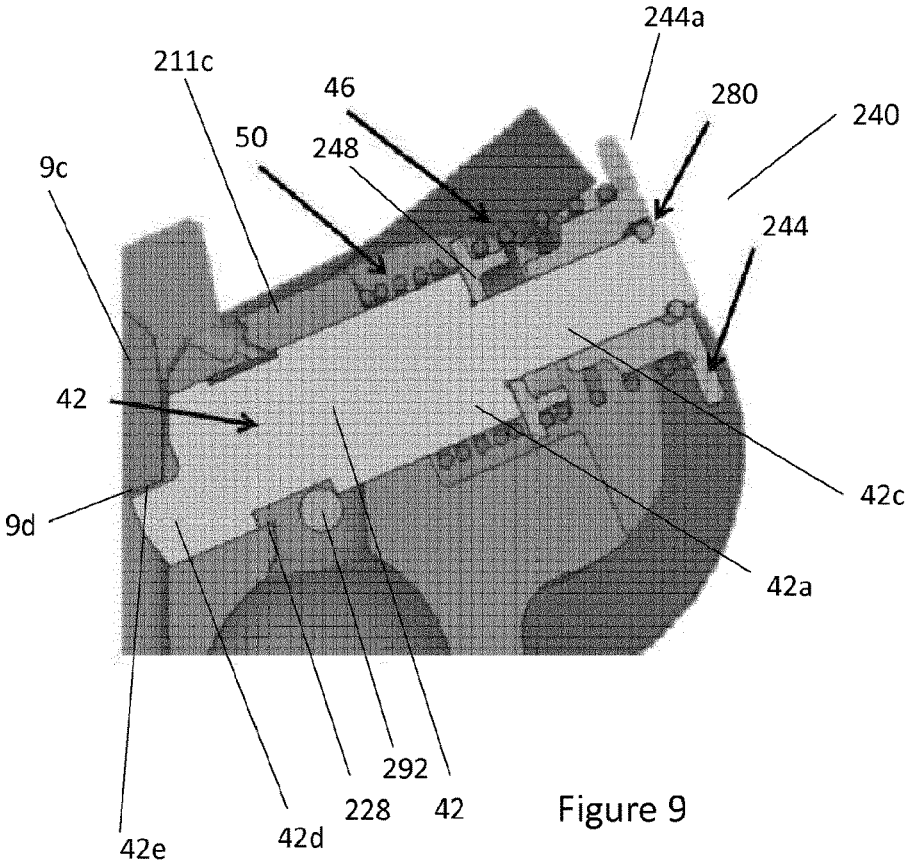
FIG. 9 shows a schematic cross sectional view through part of the another rocker arm.
Figure 10:
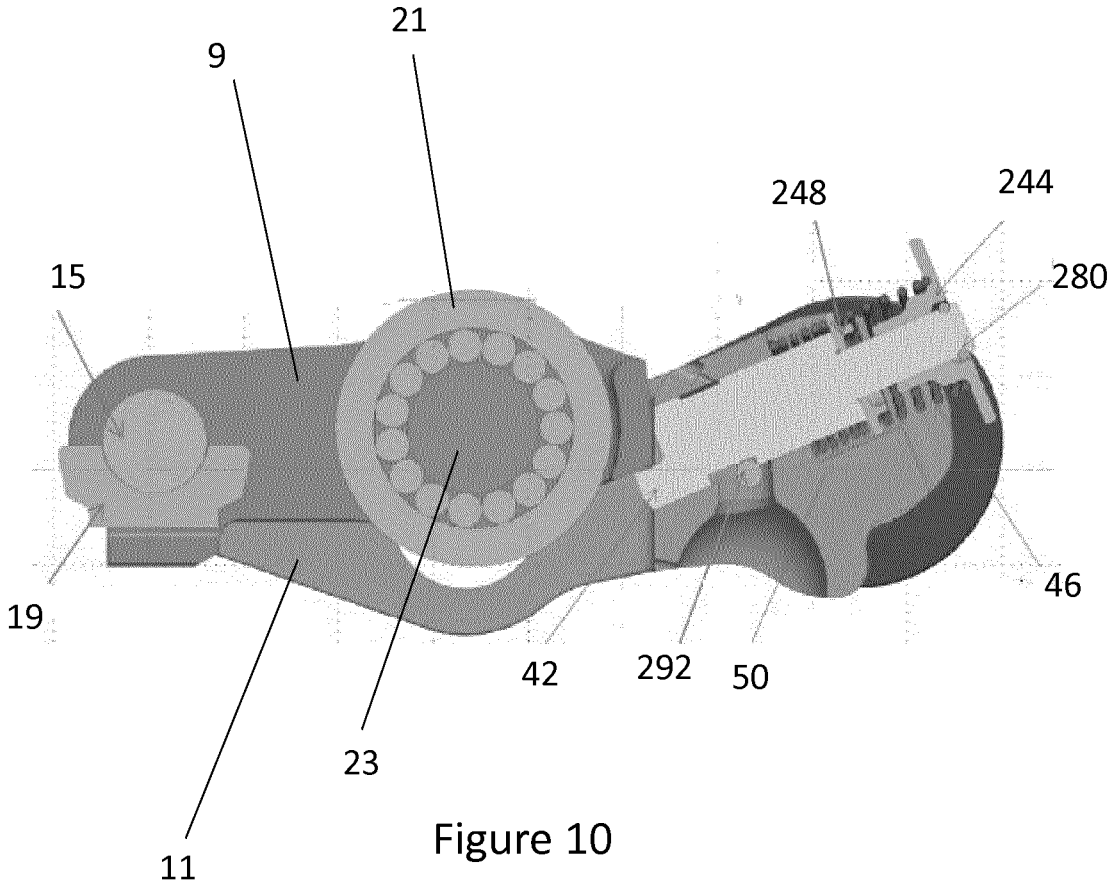
FIG. 10 shows a schematic cross sectional view through the another rocker arm.

Referring now to FIGS. 8 to 10, there is illustrated another example of a rocker arm 203 comprising a latching arrangement 240 and which function in a very similar way to the rocker arm 3 and latching arrangement 40 described above. Components of the rocker arm 203 and the latching arrangement 240 that are identical to components of the rocker arm 3 and the latching arrangement 40 are given identical reference numerals as those used above and for reasons of brevity these components will be not be described in detail again. Components of the rocker arm 203 and the latching arrangement 240 that are very similar to components of the rocker arm 3 and the latching arrangement 40 are given reference numerals that are increased by two hundred compared to those used above.

In this example, the latch pin 42 again is located in a bore or channel 228 formed in the outer body end section 211*c*. In this example, the outer body end section 211*c* is shaped so the bore or channel 228 opens out or widens or flares at the end 17 of the rocker arm so that although at least a portion of the piston member 244 is within the bore or channel 228 (which again provides for compactness) much of the piston member 244 is visible.

In this example, the piston member 244 is a hollow member that has a longitudinal bore that is slightly wider than the second end portion 42*c* of the latch pin 42 (e.g. it has a slightly wider diameter) and which is mounted in sliding contact along substantially all of its length on the second end portion 42*c* of the latch pin 42. A stopper ring 280, for example a C-clip, received in a notch formed around an outermost end of the second end portion 42*c* acts to limit the extent of the expansion stroke of the piston member 244.

The second end portion 42*c* also passes through an aperture of a retainer ring 248 which sits tightly on the second end portion 42*c* facing the piston member 244 and resting against the main body portion 42*a* of the latch pin 42. The first biasing member 46 is between a flared or flange end portion 244*a* of the piston 244 and the retainer ring 248. The return spring 50 sits around the main body portion 42*a* of the latch pin 42 between the retainer ring 248 and a part of the outer body end section 211*c*.

An orientation pin 292 (e.g. a dowel pin) is also provided to help maintain the orientation of the latch pin 42.

FIGS. 9 and 10 each illustrate the latch pin 42 in the latched position. However, similar to the examples described above, if an external actuator applies a force to the piston member 244 to try to cause the latch pin 42 to move from the fully retracted position (i.e. unlatched position) to the fully extended position (i.e. latched position) at a time when the latch pin 42 is unable to move (e.g. because of the position of the inner arm 9 as described above), the external actuator causes the piston member 244 to slide along the second end portion 42*c* of the latch pin to compress the first biasing member 46.

When the latch pin 42 is free to move again, the force generated by the compressed first biasing member 46 as it de-compresses is stronger than the force required to overcome the return spring 50 and so causes the latch pin 42 to move into the fully extended position in which it latches the inner arm and the outer arm 11 together.

In any of the above examples, the external actuator may take any suitable form and may include one or more mechanical cam arrangements, electro-magnetic actuators, hydraulic actuators or combinations thereof.

Either of the first and second modes described above may be different and may include any type of variable valve timing mode, exhaust gas recirculation mode, compression brake mode etc. as are all known to those skilled in the art.

In the described examples, it will be appreciated that the first biasing member 46 may also absorb the geometrical variations of the rocker arm resulting from tolerances of the various rocker arm components and ensure the proper engagement of the latch pin. Additionally, the piston member may absorb if necessary the contact point movement between the piston member and the external actuator through the variation of the stroke of the piston member and therefore through the compression level of the first biasing member vs the rocker angle rotation. The first biasing member 46 may effectively absorb any lash between the rocker and the external actuator.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A rocker arm for a valve train assembly, the rocker arm comprising:

a first body;

a second body mounted for pivotal movement with respect to the first body; and a latching arrangement comprising a latch pin drivable in response to an external actuator from a first position in which the first body and the second body are un-latched to a second position in which the latch pin latches the first body and the second body together, wherein the latching arrangement further comprises a piston member and a first biasing member, wherein the piston member is configured such that if the external actuator attempts to cause the latch pin to be driven from the first position to the second position at a time when the latch pin is prevented from being driven, the piston member moves to bias the biasing member so that the biasing member urges the latch pin to the second position when the latch pin again becomes driveable, wherein one of the first and second body comprises a bore or channel, wherein the latch pin and the first biasing member are at least partially mounted within the bore or channel, and wherein an end of the latch pin extends into the piston member and the piston member contains the first biasing member.

2. The rocker arm according to claim 1, wherein the piston member is at least partially within the bore or channel.

3. The rocker arm according to claim 1, wherein the bore or channel comprises a first section configured to receive at least a first part of the latching pin that comprises a latching surface and a second section configured to receive at least a part of the piston member.

4. The rocker arm according to claim 3, wherein the second section of the bore or channel is wider than the first section of the bore.

5. The rocker arm according to claim 1, wherein the rocker arm further comprises a return spring configured to bias the latch pin to the first position.

6. The rocker arm according to claim 1, wherein the piston member is at least partially within the bore or channel and a part of the piston member extends out of the bore or channel to enable the external actuator to act on the piston member.

7. The rocker arm according to claim 1, wherein the piston member comprises a retaining member on the end of the latch pin, the retaining member being configured to retain the first biasing member.

8. The rocker arm according to claim 7, wherein the retaining member is configured to limit an extent to which the piston member can extend out of the bore or channel.

9. The rocker arm according to claim 1, wherein an end of the latch pin defines a latch pin bore and the piston member is at least partially in the latch pin bore.

10. The rocker arm according to claim 9, wherein the first biasing member is arranged at least partially within the latch pin bore.

11. The rocker arm according to claim 10, wherein the first biasing member is also at least partially within the piston member.

12. The rocker arm according to claim 1, wherein the piston member comprises an aperture through which an end of the latch pin extends whereby the piston member is slidably mounted on the latch pin.

13. The rocker arm according to claim 12, wherein the first biasing member is arranged around the piston member and around the end of the latch pin.

14. The rocker arm according to claim 13, further comprising a retainer mounted on the end of the latch pin opposing the piston member, wherein the retainer is configured to retain the first biasing member and the first biasing member is between the retainer and the piston member.

15. A valve train assembly comprising the rocker of claim 1.

* * * * *